United States Patent [19]

Swan et al.

[11] 3,978,535

[45] Sept. 7, 1976

[54] BOAT WINDSHIELD MOUNTING DEVICE

[75] Inventors: Arnold H. Swan, Lake Worth; Eugene C. Beals, Hallandale, both of Fla.

[73] Assignee: American Marine Products, Inc., Fort Lauderdale, Fla.

[22] Filed: June 23, 1975

[21] Appl. No.: 589,205

[52] U.S. Cl. ..... 9/1.5

[51] Int. Cl.[2] ..... B63B 17/00

[58] Field of Search ..... 9/1 B; 244/129 W; 296/84 R, 84 A, 84 D; 49/396, 397, DIG. 2

[56] References Cited

UNITED STATES PATENTS

| | | | |
|---|---|---|---|
| 2,894,295 | 7/1959 | Singleton | 49/397 |
| 3,654,648 | 4/1972 | Wilhoit | 9/1 B |

*Primary Examiner*—Stephen G. Kunin
*Assistant Examiner*—Sherman D. Basinger
*Attorney, Agent, or Firm*—Malin & Haley

[57] ABSTRACT

An improved boat windshield mounting device which greatly reduces the time required to mount and install a windshield on a boat, skiff or the like in which the windshield sill frame members, both front and wing, are interlocked to a mounting strip which is fastened by screws to the deck of the vessel. The mounting strip includes an elongated, aluminum strip substantially L-shaped in which the smaller leg has a bulbous shaped flange disposed thereto with the smaller leg of the mounting strip being interlocked and received into a chamber in the windshield sill frame members, the chamber having a restricted opening which firmly couples and interlocks the sill frame members to the mounting strip. The mounting strip and the sill frame members are interlocked before the mounting strip is fastened by screws to the deck. The mounting strip, including the smaller leg and the flange disposed thereto, is shaped to be usable on both the front sill frame member and the wing sill frame member, even though the front windshield and the wing windshield are disposed at different relative angles to the deck. Additionally, the front and wing sill frame members include a T-shaped groove adjacent the edge along the bottom surface which receives and holds a resilient seal between the sill frame members and the mounting strip which is utilized as required by installation of the windshield.

5 Claims, 4 Drawing Figures

BOAT WINDSHIELD MOUNTING DEVICE

BACKGROUND OF THE INVENTION

This invention relates generally to a boat windshield mounting device, and more specifically to a boat windshield which includes a deck fastened mounting strip which is slidably interlocked to front and wing sill frame members of the windshield. In present day boat construction, especially skiffs, runabouts and motor boats, it is required that the construction of a vessel include extensive application of styrofoam underneath the deck surface for additional buoyancy in case of emergencies. The application of styrofoam under the front deck has greatly increased the labor time required for mounting the windshield to the boat deck in that access to the underside of the boat deck is extremely limited. Prior art windshield mounting devices which use nut and bolt connectors require underside access for installation, greatly increasing the windshield mounting time.

The instant invention does not require access to the underside of the boat deck, reducing greatly installation time. With the instant invention, which includes front and wing sill windshield frame members having a chamber disposed along their bottom surface, the chamber having a restricted opening, a rigid unitary mounting strip is interlocked into the sill frame chamber and fastened by sheet metal screws to the deck. Thus, the windshield may be mounted from the top of the deck without regard to access below the deck to achieve rigid mounting and fastening of the windshield to the boat deck itself. The construction of the mounting device includes an additional channel disposed in the bottom surface of the sill frame members which receive a resilient gasket or seal to prevent moisture or water from being received between the connection of the sill frame member and the mounting strip.

BRIEF DESCRIPTION OF THE INVENTION

A mounting device for mounting a boat windshield to the deck of a vessel comprising an elongated L-shaped mounting strip, said strip having on the end of its shorter leg a bulbous flange and at least one windshield sill frame member having a chamber disposed along its bottom surface, said chamber including a restricted opening such that the bulbous flange of the mounting strip is sized to be slidably interlocked into the frame member chamber. The mounting strip is laterally sized so that when the windshield sill frame members are interlocked, a sufficient lateral portion of the strip is readily accessible and includes a plurality of countersunk holes or apertures for receiving screws which are fastened to the deck of the vessel. The sill frame member chamber has sidewalls which are shaped and sized in conjunction with the shape of the bulbous flange of the mounting strip to permit slight relative movement laterally between each other which allows the mounting strip interlock to compensate for slight variations in the deck windshield mounting angle. The sill frame members may be constructed of aluminum and are extruded in substantially an H cross-sectional shape, with the front sill frame having a bottom surface disposed at an angular relationship to its sides, which allows for the bottom surface to align with the deck such that the front windshield may be mounted at an angle relative to the deck surface of the vessel. The sill frame members include an additional groove disposed along the bottom surface which is substantially T-shaped and receives a resilient gasket or seal which is utilized as required by installation of the windshield.

In mounting the windshield to the deck of a vessel, the sill frame members, both front and wing, are slidably interlocked to the mounting strip with the entire windshield then intact, ready to be mounted on the vessel. After the windshield is positioned on the deck, a plurality of screws are then fastened through the apertures in the mounting strip, thus rigidly mounting the entire windshield to the deck in a very efficient manner. Fastening with the screws is accomplished with the total windshield assembled in its final form such that no additional interlocking or fastening is necessary once the mounting strip is rigidly fastened to the deck. The front and wing sill frame members are constructed of extruded aluminum, as is the mounting strip. The gasket may be constructed of a rubber or plastic strip. Additionally in mounting the windshield to the deck, an adhesive strip may be first placed on the deck over which the mounting strip is placed. The vertically oriented center and corner posts are constructed slightly longer than the windshield height in order to slightly raise the bottom windshield frame members (which connect to the mounting strip) above the deck mounting surface providing tension for the sill members against the corner posts, reducing vibration and play in the entire windshield, after the windshield is mounted.

In accordance with the operation of the instant invention, there is a slight gap or space provided between the sidewalls of the bulbous flange and the inner chamber walls above the restricted opening which does allow for a certain amount of movement rotationally in a lateral direction between the sill members and the mounting strip flange such that, although interlocked rigidly, the slight movement allows for compensation and mounting with respect to slight irregularities in the surface of the deck.

It is an object of this invention to provide an improved interlocking coupling member utilized for mounting a boat windshield to the deck of a boat.

It is another object of this invention to provide an improved boat windshield mounting device which reduces the mounting labor time, reduces the costs of materials and improves deck and windshield coupling.

And still yet another object of this invention is to eliminate the use of moveable fasteners found in the prior art in the mounting of a boat windshield to the deck of a boat.

But still yet another object of this invention is to provide an improved windshield sill member and mounting strip interlock having a sealing means disposed therebetween.

In accordance with these and other objects which will be discussed hereinafter, the instant invention will now be described with particular reference to the accompanying drawings.

PREFERRED EMBODIMENT OF THE INVENTION

Figure 1:
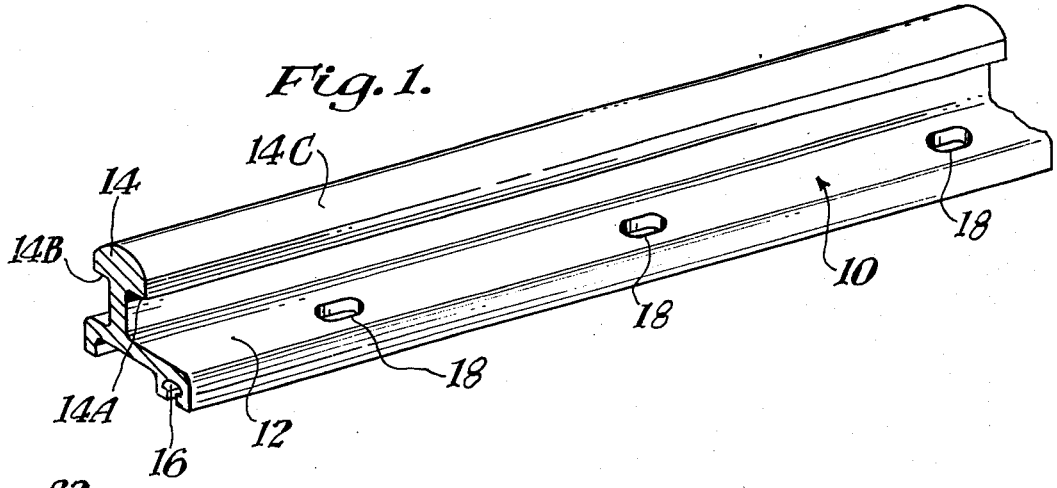
FIG. 1 shows a perspective view of the mounting strip as utilized in the instant invention.

Referring now to the drawings and especially FIG. 1, the mounting strip for mounting the windshield to the boat deck in accordance with the instant invention is shown comprising an elongated, extruded, aluminum bar 10 which includes a flat L-shaped strip 12 having disposed at the end of its smaller leg a bulbous flange 14 having a curved upper portion 14C, substantially vertical side surfaces 14A and horizontal flange surfaces 14B which are perpendicular to the small leg of L-shaped strip 12. The body of the L-shaped strip 12 includes a plurality of countersunk apertures or holes 18 which are sized to receive sheet metal screws (not shown). The bottom surface of L-shaped strip 12 includes, adjacent the longer lateral bottom surface, a T-shaped groove 16 which receives a resilient gasket or seal (not shown in FIG. 1).

Figure 2:
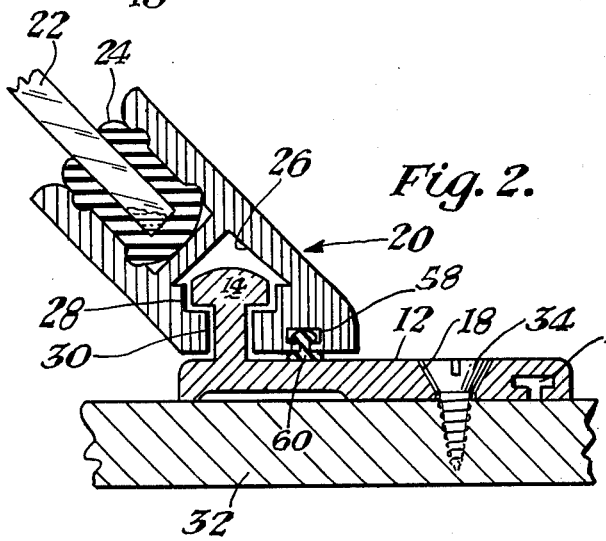
FIG. 2 shows a side elevational view in cross-section of the mounting strip and front sill frame member utilized for mounting a front windshield to the deck of a boat.

FIG. 2 shows the instant invention as utilized for mounting the front windshield to a boat deck 32 with the front sill frame member 20 including a chamber 26 which is disposed adjacent the bottom surface of sill 20 and includes a restricted opening or passageway 30 and a wider passageway 28 adjacent thereto. The sill frame member 20 is shown coupled to glass pane 22 with a resilient gasket 24 interlocked thereto. Disposed along the bottom surface of sill 20 is a T-shaped groove which receives in one embodiment a resilient seal 60. The seal or gasket 60 acts to resiliently interface the bottom surface of sill 20 and the upper surface above L-shaped mounting strip 12 while also providing a moisture or water seal between the sill and mounting strip. The mounting strip is shown fastened to deck 32 by screw 34. The body of the L-shaped mounting strip 12 includes a groove 16 along its bottom surface for receiving an additional gasket or seal as desired. An adhesive strip may be positioned between the deck upper surface and the bottom surface of the mounting strip 12. A bulbous flange 14 disposed at the end of the short leg of mounting strip 12 is sized and received within chamber 26 of sill 20. The lateral width of the bulbous flange 14 is in such relationship to the width of the chamber restricted wall surfaces 28 and 30 that a small space exists to allow slight relative movement between the upper surface of the mounting strip 12 and the bottom of sill 20.

Figure 4:
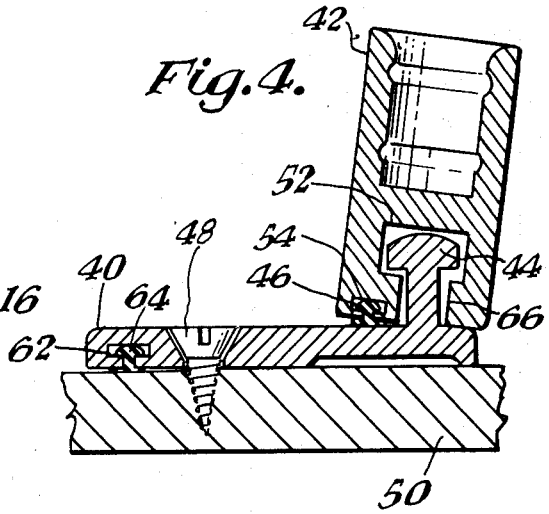
FIG. 4 shows a side elevational in cross-section of the mounting strip and wing sill frame members as constructed in accordance with the instant invention.
Figure 3:
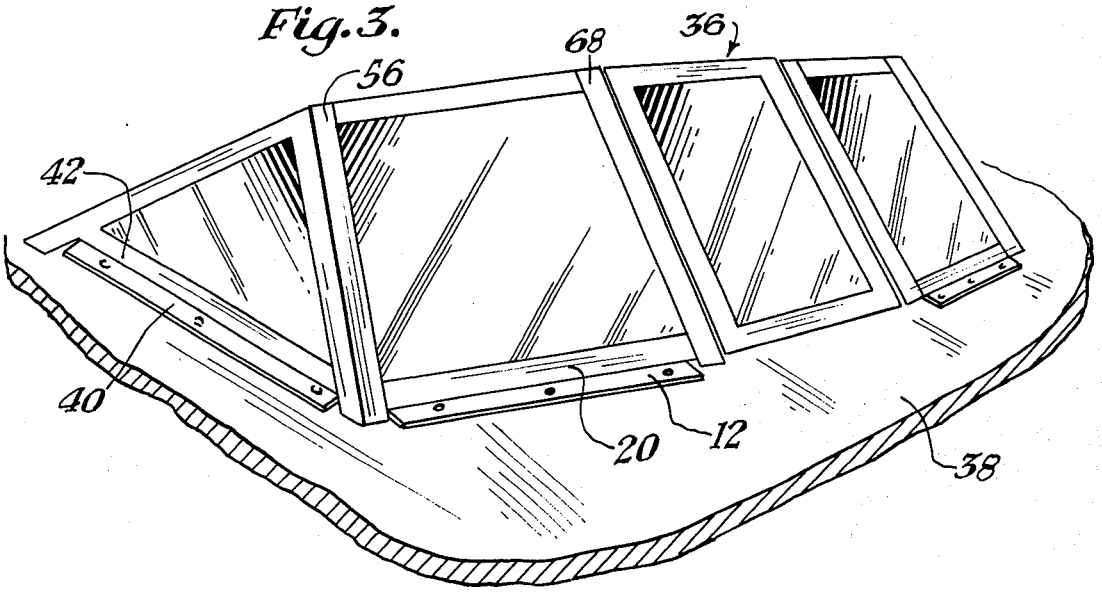
FIG. 3 shows a perspective view of a boat windshield and a mounting device in accordance with the instant invention.

FIG. 3 shows a windshield 36 as it is mounted to a boat, skiff or vessel deck 38, including the mounting strip 12 and front sill frame 20. The side frame members, such as corner frame 56 allows for the wing frame and the front main frame of the windshield to be interlocked in a conventional manner. The wing includes a mounting strip 40 which is identical in construction to mounting strip 12 connected to wing sill frame member 42 as shown in FIG. 4. The wing sill frame member 42 includes a chamber 52 having a restricted opening 66 which receives the bulbous flange 44 of L-shaped mounting strip 40. The construction of the L-shaped mounting strip 40 is identical with that described in FIG. 2 and includes a T-shaped channel 62 on the bottom surface for receiving a resilient gasket or seal 64. The mounting strip 40 is fastened to boat deck 50 by a plurality of sheet metal screws 48 or other suitable fasteners. The wing frames are mounted more vertically than the front main frames, thus requiring a different bottom surface angle for frame member 42. A slight space is provided between the wider chamber walls 52 and 66 and the lateral edge surfaces of the bulbous flange 44 to again provide a certain amount of relative movement between the sill frame member 42 and the mounting strip 40.

Referring back to FIG. 3, the center and side posts 68 and 56 respectively are constructed slightly longer in order to raise the bottom frame sill above the deck before the mounting strip is fastened to the deck. The screws in the mounting strip act to tension the entire windshield as it is attached to the deck.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A boat windshield mounting device for mounting the windshield of a boat to a boat deck comprising:

an elongated metal strip having a first and second lateral edge, said strip including a plurality of apertures spaced apart and longitudinally disposed near said first edge for receiving fasteners and unitarily constructed therewith a raised vertically disposed flange having a T-shaped cross-section disposed near said second lateral edge of said strip, said flange running the length of said strip;

a boat windshield frame member, said frame member including a T-shaped groove disposed along its bottom side, said raised flange interlockably receivable into said frame member groove, said first lateral edge sized to project beyond said frame member exposing said apertures; and a plurality of fasteners receivable through said strip apertures and fastenable to said deck from a single direction.

2. A boat windshield mounting device, as in claim 1, wherein: said elongated strip includes a seal receiving groove disposed along the bottom surface of said strip; and resilient sealing strip connected into said strip groove.

3. A boat windshield mounting device, as in claim 1, wherein:

said T-shaped flange sides are sized to provide a relatively small space between said flange sides and the inside walls of said T-shaped frame groove.

4. A boat windshield mounting device for attaching a windshield bottom frame member to a boat deck comprising:

a rigid, elongated, deck-mounted strip, said strip having a substantially perpendicular flange integrally formed therewith protruding from one side of said strip, said flange disposed along the longitudinal length of said strip, and said flange having a relatively enlarged lip along its free end;

a windshield frame member disposed on the bottom of a windshield, said frame member having an upper surface having a groove for receiving a window pane, a pair of angularly inclined sides, and a bottom surface having a strip flange interlocking channel, said channel disposed in said windshield bottom frame member bottom surface including an enlarged, cross-sectional portion and a constricted slot portion, said constricted slot portion disposed within the frame bottom surface and said enlarged portion disposed in communication with the constricted slot, the enlarged lip of said flange having a slightly smaller width than the width of the enlarged portion of said channel; and, a plurality of deck fasteners receivable through strip apertures and fastenable to said deck, said elongated strip width having a portion along one lateral edge that extends beyond one of the inclined side walls of said windshield bottom frame member exposing said fastening apertures, said windshield bottom frame member being interlocked with said deck engaging mounting strip; and, a plurality of deck fasteners receivable through said strip apertures for fastening said elongated strip to said deck.

5. A boat windshield mounting device, as in claim 4, wherein:

said enlarged flange lip includes an arcuate upper surface and perpendicularly cornered lower surfaces and said windshield bottom frame member channel includes a rectangularly cornered groove disposed between said enlarged channel portion and the constricted portion, said rectangularly cornered groove is sized to receive a slightly larger width than that of the flange lower surfaces.

* * * * *